US005470248A

United States Patent [19]

Wood

[11] Patent Number: 5,470,248

[45] Date of Patent: Nov. 28, 1995

[54] FIELD REPAIRABLE ELECTRICAL CONNECTOR

[75] Inventor: Richard G. Wood, Magnolia, Tex.

[73] Assignee: Tescorp Seismic Products, Inc., Houston, Tex.

[21] Appl. No.: 226,009

[22] Filed: Apr. 11, 1994

[51] Int. Cl.[6] ..... H01R 13/52

[52] U.S. Cl. ..... 439/281; 439/271; 439/587

[58] Field of Search ..... 439/692, 736, 439/271, 281, 587, 651, 655

[56] References Cited

U.S. PATENT DOCUMENTS

| | | | |
|---|---|---|---|
| H113 | 8/1986 | McNeel | 439/282 |
| 2,881,406 | 4/1959 | Arson | 439/589 |
| 3,641,479 | 2/1972 | O'Brien et al. | 439/277 |
| 3,783,434 | 1/1974 | Ransford | 439/281 |
| 3,888,559 | 6/1975 | Geib | 439/281 X |
| 3,937,545 | 2/1976 | Cairns et al. | 439/281 X |
| 3,954,154 | 4/1976 | Kruppenbach et al. | 181/112 |
| 4,090,759 | 5/1978 | Herrmann | 439/281 |
| 4,150,866 | 4/1979 | Snyder et al. | 439/275 |
| 4,284,312 | 8/1981 | Patchett et al. | 439/281 |
| 4,497,531 | 2/1985 | Baker | 439/587 X |
| 4,758,174 | 7/1988 | Michaels et al. | 939/281 OR |
| 4,767,349 | 8/1988 | Pottier et al. | 439/191 |
| 4,767,356 | 8/1988 | Grappe | 439/455 |
| 5,120,268 | 6/1992 | Gerrans | 439/736 |
| 5,145,410 | 9/1992 | Maejima et al. | 439/587 |
| 5,362,258 | 11/1994 | Arnswald et al. | 439/271 X |
| 5,387,119 | 2/1995 | Wood | 439/218 OR |

FOREIGN PATENT DOCUMENTS

| | | | |
|---|---|---|---|
| 63398 | 8/1986 | German Dem. Rep. | 439/281 |
| 2131633 | 6/1984 | United Kingdom | 439/587 |

*Primary Examiner*—Larry I. Schwartz
*Assistant Examiner*—Daniel Wittels
*Attorney, Agent, or Firm*—P. Weston Muesselman, Jr.; Robert A. McFall; Jenkens & Gilchrist

[57] ABSTRACT

An electrical connector having pin members that are partially encapsulated within, and sockets members that are completely encapsulated within, rigid, electrically nonconductive sheaths that are respectively integrally formed in male and female body members. The male and female body members are joined together by a resiliently compressible coupling member that has a plurality of passageways that seal around each of the sheaths. The male and female body members and the coupling member are disassemblable and individually repairable or replaceable without the use of special tools or equipment.

15 Claims, 2 Drawing Sheets

FIELD REPAIRABLE ELECTRICAL CONNECTOR

TECHNICAL FIELD

This invention relates generally to a field repairable electrical connector that is adaptable for use in either underwater or dry land applications, and more particularly to such a connector having a removable, resiliently compressible coupling member disposed between rigid male and female body members.

BACKGROUND ART

A long standing problem with electrical connectors in general, and specifically with sealed connectors intended for use in underwater applications, has been the inability to service and repair such connectors in the field. In general, such connectors must be disassembled in a repair shop and molded component assemblies replaced with new components. Furthermore, to make an electrical connection waterproof, it has heretofore been necessary that at least one part of the male or female member of the connector be formed of, or equipped with, a relatively soft, deformable element, to provide a seal around the electrically conductive parts of the connector or, alternatively, enclose the entire connector within a sealed case.

For example, copending U.S. patent application No. 08/134,075, filed Oct. 8, 1993, now U.S. Pat. No. 5,387,119 by the inventor of the present invention, discloses an underwater electrical connector having a male member formed of a rigid plastic material that has a plurality of pins partially enclosed by a sheath formed of the same rigid plastic material. The underwater connector has a female member formed of an elastomeric material and has a plurality of passageways formed in the elastomeric material in which a portion of the passageway sealably surrounds the rigid sheaths of the male member. This arrangement provides an excellent waterproof seal to exclude moisture from the connection between the pin and a socket encapsulated within the female member. However, this construction makes it necessary to enclose the separated wires of the cable bundle, and the individual connections between the wires and the sockets in the female connector, in a single molded component. Thus, it is not possible, in the field, to replace only the female connector because the repair must necessarily include the cable to which the female member is molded. Also, since the sockets are embedded in a relatively soft, deformable material, it is possible for the sockets to become slightly misaligned, permitting the sockets to move, or even bend, during insertion of the pins and subsequent use of the connector. This characteristic, while desirable for sealing, makes it more difficult, over a period of time, to maintain the desirable alignment of the sockets with a respective pin of the male connector.

Other electrical connectors have male or female members, or both, in which the respective pins and sockets are encased in a relatively soft, elastomeric body that is surrounded by a hard plastic or metallic case. When the body and case are constructed of materials having different physical characteristics, even though they are initially bonded together, the components are prone to subsequent separation and failure.

The present invention is directed to overcoming the problems set forth above. It is desirable to have an electrical connector that is easily repairable in the field and is useable in both underwater and dry land environments. For such underwater uses, it is desirable that the sealing capability of the connector increases in response to an increase in the water pressure imposed on the connector at greater depths. It is also desirable to have such an electrical connector in which both the male and female components of the connector are each formed of a single, rigid material.

BEST MODE FOR CARRYING OUT THE INVENTION

Figure 1:
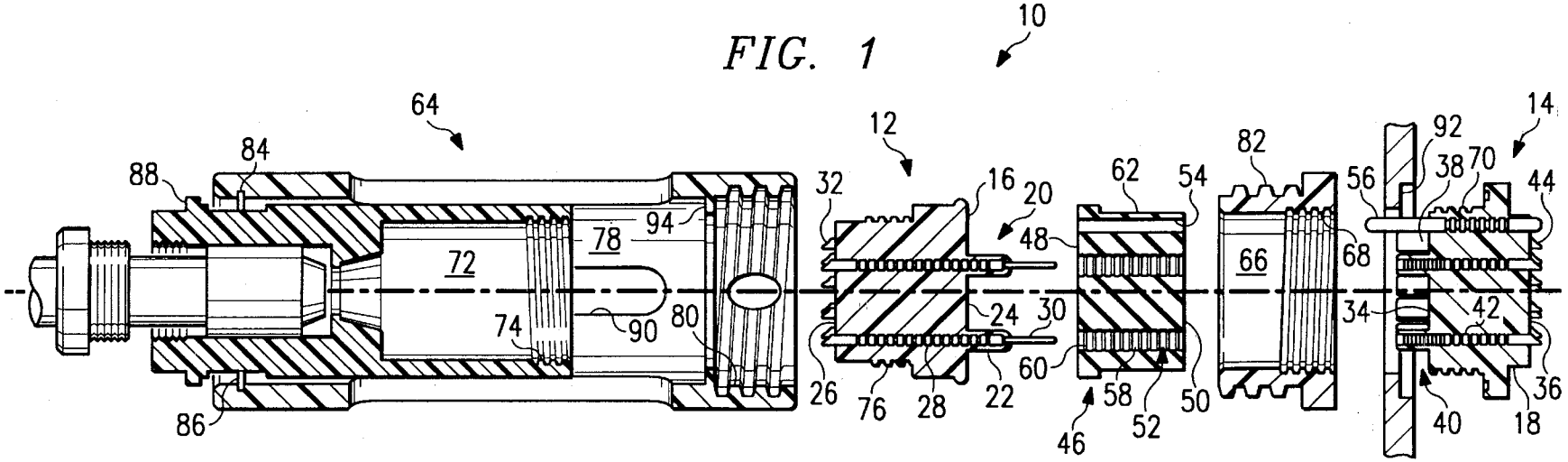
FIG. 1 is a longitudinal cross section of an electrical connector embodying the present invention, showing the components of the connector in unassembled, spaced apart relationship.

In the preferred embodiment of the present invention, an electrical connector 10 has a male member 12 and a female member 14, both of which have a body portion 16,18 respectively, that is formed of a single, hard, rigid, electrically nonconductive material. Preferably the material is an injection moldable glass filled urethane.

The male member 12 also includes a plurality of electrically conductive pins 20 that are arranged in a predetermined pattern within a mold cavity prior to injection molding the body 16. Simultaneously with molding the body 16, a sheath 22 is formed about a portion of each of the pins 20 thereby, through shrinkage during solidification after molding, tightly encapsulating each of the pins not only within the body 16 but also within a respective sheath 22. The sheaths 22 extend outwardly from a first face surface 24 of the body 16, which also has a second face surface 26 spaced from the first face surface 24.

Each of the pins 20 have a first portion 28 completely encapsulated within the body 16 and a respective one of the sheaths 22, an exposed second portion 30 extending outwardly from a distal end of the sheath 22, and an exposed third portion 32 extending outwardly from the second face surface 26 of the body 16. The outer surface of the first, or encapsulated, portion 28 of the pins 20 preferably have a plurality of inwardly extending annular grooves to aid in the retention of the pins 20 in the body 16 and to improve sealing of the body 16 and sheath 22 around each of the pins 20. The third portion 32 of the pins 20 preferably have a socket formed therein for receiving the pin end of an insertable/removable solder lug that is soldered to a wire conductor (not shown). Alternatively, although less desirable from a field repair aspect, the solder lug may be directly formed on the outer end of the pin 20.

The body portion 18 of the female member 14 has a first face surface 34, a second face surface 36 spaced from the first face surface 34, and a plurality of integrally formed sheaths 38 extending outwardly from the first face surface 34. The female member 14 also includes a plurality of electrically conductive sockets 40 that are arranged in the same predetermined pattern as the pins 20. Each of the sockets 40 are shaped to receive substantially all of the exposed second portion 30 of the pins 20 and grip the pins so that they are maintained in electrically conductive contact with the socket 40. In the preferred embodiment of the present invention, the pin receiving portions of the sockets 40 are shaped so that it has a depth slightly greater than the length of the exposed first portion 28 of the pins 20 to assure that the pins will not "bottom out" in socket. Also, it is desirable that the end of the sheaths 22,38 surrounding the pins and sockets be slightly spaced apart to preclude potential wear or damage to the sheaths.

Each of the sockets 40 have a first portion 42 in which the outer perimeter of the socket is completely encapsulated within the body 18 and a respective one of the sheaths 38 of the female member 14, and a second portion 44 that extends outwardly from the second face surface 36 of the body 18. Preferably, a plurality of annular grooves are provided along at least a portion of the length of the outer surface of the sockets 40 to assure retention of the socket in the body 18 and enhance sealing between the socket 40 and the body. The second portion 44 of the sockets 40 preferably have a solder lug formed on an outer end for attachment of a wire conductor (not shown).

The electrical connector 10 embodying the present invention also has an elastomeric coupling member 46 that is preferably formed of an injection moldable, resiliently compressible and electrically nonconductive material such as thermoplastic rubber. In particular, it has been found that a blend of polyethylene and neoprene rubber, provides the resilience and compressibility desirable for sealing the sheaths as described below in more detail. Preferably, after curing, the coupling member 46 has a hardness of from about 40 to about 70 durometer as measured by the Shore A scale.

The coupling member 46 has a first face surface 48 that is shaped so that it is able to tightly abut and seal against the first face surface 24 of the male member 12, and a second face surface 50 that is shaped to enable it to abut, in a sealing relationship, against the first face surface 34 of the female member 14.

The coupling member 46 also has a plurality of passageways 52 extending between the first and second face surfaces 48,50 of the coupling 46. The passageways 52 are arranged in the same predetermined pattern as the pins 20 and the sockets 40. It is also desirable that the coupling member 46 have a locator hole 54 adapted to receive a locator pin 56, preferably provided on the female member 14, to aid radial orientation of the coupling 46 when connecting the components together.

Each of the passageways 52 have an internal wall surface that is shaped to receive and completely surround each of the sheaths 22,38 on the body portions 16,18 of the male and female members 12,14. In arid above ground applications where water or moisture sealing is not required, the internal wall surfaces may advantageously have a smooth cylindrical surface with an internal diameter substantially the same as, or even slightly greater than, the external diameter of the sheaths 20,40.

In underwater uses however, it is desirable to provide a fight waterproof seal about the sheaths 20,40. For this purpose, each of the passageways 52 in the preferred embodiment of the present invention have a generally circular cross sectional shape in which at least one, and desirably a plurality of, annular alternating grooves 58 and ridges 60 are formed. The ridges 60 preferably have an internal diameter slightly less than the diameter of the sheaths 22,38 so that, when the sheaths are inserted into the passageways 52, each of the ridges 60 form a lip, or O-ring type, seal about the circumference of each sheath. Importantly, when the connector 10 is mated, or connected, underwater, the ridges 60 clears water from the pin-socket connection. It has also been found that if, after initial connection of the components, the components are subsequently slightly separated, e.g., moved apart about ¼ inch (0.64 cm), and then rejoined, the ridges coact to provide a pumping action that further clears water from the pin-socket joint.

In an actual construction of the connector 10 embodying the present invention, each of the sheaths 22,38 have an external diameter of 0.200 inches (0.079 cm), and each of the ridges 60 have a diameter of 0.150 inches (0.059 cm). The annular grooves 58 between the ridges 60 in the passageways 52 have a diameter of 0.205 inches (0.081 cm) which is slightly greater than the external diameter of the sheaths 22,38.

Thus, it can be seen that underwater sealing of the electrical connection between a pin 20 and a socket 40 is not dependent upon forming a face seal between the coupling member 46 and either the male or the female member 12,14. Importantly, because underwater sealing of the electrical connection is provided by the internally disposed ridges 60 in each of the passageways 52, the application of an essentially isostatic pressure, such as that applied by subsurface water pressure, will compress an outer circumferential surface 62 of the elastomeric coupling 46 and increase the pressure that the internally disposed ridges 60 apply against each of the sheaths 22,38. That is, the sealing pressure imposed by the passageways 52 about each of the sheaths 22,38 will increase in response to increased pressure on the outer circumferential surface 62.

As discussed above, if sealing against moisture or water is not required, such as in dry desert applications, it is desirable to form a single smooth cylindrical wall in the passageway 52 that is somewhat greater than the external diameter of the sheaths 22,38. For example, in the above described actual. construction in which the external diameter of the sheaths was 0.200 inches (0.079 cm) the internal passageways 52 would preferably be formed to a diameter of, for example, about 0.210 inches (0.083 cm).

Thus, it can be seen that by simply changing the coupling member 46, i.e., selecting a coupling members having either smooth wall or ridged wall passageways, the connector 10 can be adapted for use in applications having very different environmental requirements. Also, if the pins and sockets 20,40 are arranged in a symmetrical pattern, the coupling member 46 is reversible, i.e., it can be installed with either face 48,50 abutting either the male member 12 or the female member 14.

In the above described actual construction, the sheaths 22 surrounding the pins 20 have a length of 0.581 inch (1.48 cm) and the sheaths 38 surrounding the sockets 40 have a length of 0.400 inch (1.02 cm). Thus, the total combined length of the sheaths 22,38 is 0.981 inches (2.49 cm). The length of the coupling member 46, and accordingly the length of the passageways 52 in the coupling member is 1.081 inches (2.75 cm). Therefore, upon assembly, as described below in additional detail, there will be a gap, or "stand-of distance", of about 0.100 inch (0.25 cm) between the ends of the sheaths 22,38.

Importantly, the length of the sheaths 22 surrounding the pins 20 is longer than the length of the sheaths 38 formed around the sockets 40. Therefore, there is more contact surface between the pin sheaths 22 and the internal surfaces of the passageways 52 in the coupling 46 than between the socket sheaths 38 and the passageways. Because of the greater contact area, the coupling member 46 will, upon disassembly, be captured by and retained with the male member 12. Also, because each of the passageways 52 is longer than the combined length of the pin sheath 22 and the exposed pin portion 30, each of the exposed pin portions 30 are completely surrounded and protects the pins 20 from damage during handling or repair operations. Preferably, the electrical connector 10 includes a means 64 for maintaining the first and second face surfaces 48,50 of the coupling 46 in respective abutting contact with the first face surfaces 24,34 of the male and female members 12,14, In the illustrative embodiment of the present invention shown in FIGS. 1 and 2, the means 64 includes a female adaptor member 66 having internal threads 68 which are threadably engageable with a plurality of threads 70 provided on a circumferential surface of the female member 14. The female adaptor 66 secures the female member 14 in a fixed mounted position against a wall or case surface by drawing an annular shoulder on the circumference of the female member against the wall in response to tightening the threaded connection between the adaptor 66 and female member 14.

In similar fashion, a male adaptor member 72 has internal threads 74, formed adjacent one end, which are adapted to threadably engage a plurality of external threads 76 formed on the male member 12. The male adaptor 76 preferably has a provision for receiving a cable containing a plurality of wires in the other end and for sealing the entrance of the cable into the male adaptor 72. Alternatively, although less desirable for field repairs, the cable may be directly molded to the male member 12, thereby forming a single integrated component.

Figure 2:
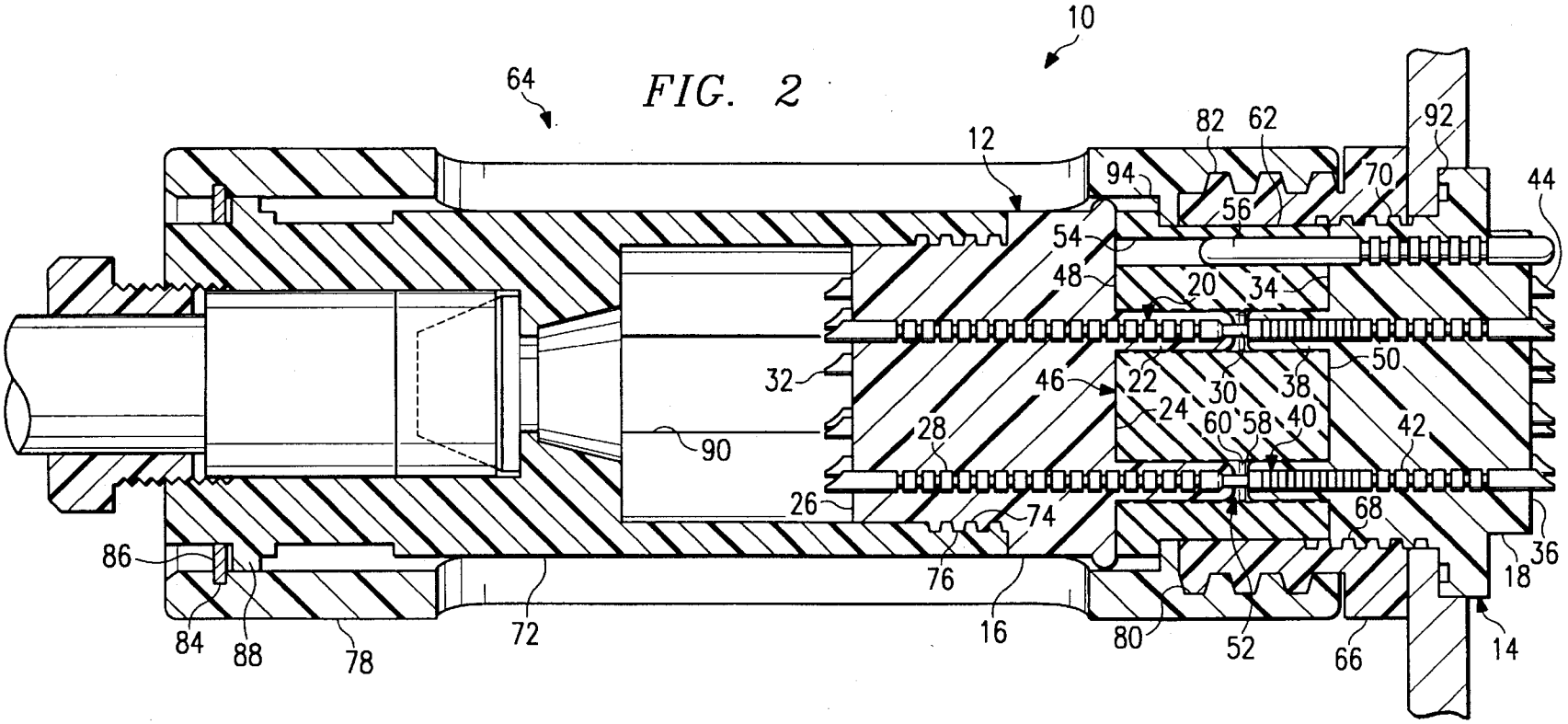
FIG. 2 is a longitudinal cross section of the electrical connector shown in FIG. 1, showing the components of the connector in assembled relationship.

The means 64 for maintaining the coupling 46 and the male and female members 12,14 in their respective abutting relationships also includes a rigid outer shell 78 that has a plurality of internal threads 80 disposed at one end of the shell that are adapted to mate with a plurality of external threads 82 provided on the female adaptor member 66. The shell 78 also has an internally disposed groove 84 adjacent the other end which is adapted to receive a snap ring 86 that, when the connector 10 is assembled as shown in FIG. 2, abuts a shoulder 88 formed on the outer surface of the male adapter member 72. It is also desirable that the outer shell 78 have a plurality of open slots 90 extending through the periphery of the shell. The slots 90 advantageously provide an aid to gripping and turning the shell during assembly or disassembly of the connector, and additionally provide an important self cleaning action. For these purposes, it is even desirable that at least part of the threaded portion of the outer shell 78 also have open slots 90 through the shell.

Preferably the female adaptor member 66, the male adaptor member 72, and the shell 78 are all constructed of a rigid plastic material, such as fiberglass filled polyurethane, that is electrically nonconductive, resistant to corrosion, and easily formable by conventional molding techniques.

The electrical connector 10 is assembled, as shown in FIG. 2, by first inserting the female member 14 through one side of an aperture 92 in a data box or control panel, with a shoulder of the female member having an o-ring seal disposed therein in contact with the panel. The female adapter member 66 is then threaded onto the female member 14 and tightened against the mounting wall or panel. This effectively locks the female member 14 in place with respect to the fixed wall surface.

The elastomeric coupling member 46 is then inserted over the pins 20 and the sheaths 22 of the male member 12. Next, while not entirely necessary because of the below described subsequent drawing of the element together, the coupling member 46 is desirably pushed onto the male member 12 until the second face surface 50 of the coupling member is in abutting contact with the face surface 24 of the body member 16.

The male adapter member 72 is then joined with the assembled coupling and male members 46,12 by threading the external threads 76 on the male member into the internal threads 74 in the male adapter member 72. Prior to this last step, unless already connected, the individual lead wires from a line cable assembly are attached to the ends, i.e., the third portion 32, of the pins 20.

The assembled coupling member 46, male member 12 with wires attached, and male adaptor member 72 are then inserted, as a unit, through the left end (as viewed in FIGS. 1 and 2) of the outer shell 78 to a position at which the shoulder 88 on the male adapter member 72 passes to the right of the groove 84 in the outer shell 78. The snap ring 86 is then inserted into the groove 84 which coacts with the shoulder 84 to prevent leftward movement of the male adaptor member 72 and the components previously assembled therewith.

The coupling member 46, male member 12 and the male adaptor 72 are rotated, if needed, to align the locator hole 54 in the coupling member with the locator pin 56. The outer shell 78 is then moved into contact with the female adaptor member 66 and rotated to engage the internal threads 80 on the outer shell with the external threads 82 on the female adapter member. Preferably, an anti-friction fiber washer is prepositioned between an inwardly extending shoulder 94 of the outer shell and an outwardly extending flange on the coupling member 46. Tightening the outer shell 78 against the female adapter member 66 will draw the male and female members 12,14, toward the coupling member 46 that is positioned between the male and female members. Thus, after tightening the outer shell 78 onto the female adaptor member 66, the second face surface 50 of the coupling member 46 and the first face surface 34 of the female member 14, and the first face surface 24 of the male member 12 and the first face surface 48 of the coupling member 46, are in respective abutting contact with each other. After assembly, the exposed pins 20 of the male member 12 captured by, and maintained in electrical contact with, the sockets 40 and the sheaths 22,38 of both the male and female members 12,14 are effectively sealed by the passageways 52 of the resiliently compressible coupling member 46.

Importantly, as described above, the length of the sheaths 22 of the male member 12 are longer than sheaths 38 of the female member 14. Upon disassembly, the inwardly extending shoulder 94 formed on the outer shell 78 will pull the coupling member 46 away from of the female member 14. Also, as a result of the greater contact area between the male sheath 22 and the interior surface of the passageways 52, the coupling member 46 is captured by, and retained on, the male member 12. This makes subsequent reassembly, particularly underwater, easier because it eliminates the need to separately orient and install the coupling member 46 on the male member 12. Also, as described above, the coupling member 46 extends beyond the ends of the pins 20 of the male member 12, thereby protecting the pins when the connector 10 is in an uncoupled state.

The assembled electrical connector 10 is easily disassembled, in the field, by reversal of the above described assembly procedure. Thus, as described with respect to the construction of the sheaths 22,38 and the passageways 52, it can be seen that the connector 10 can be disassembled and reassembled for service, even underwater if necessary. The coupling member 46 and the male and female members 12,14 are immediately field replaceable. The male and female member 12,14 may be individually replaced by removing the solder tabs from the socket connection provides on the ends of the pins 20 and the sockets 40.

In another embodiment, the electrical connector 10 is used as a line connector, i.e., without one of the members mounted in a box or to a wall. Other applications, changes and modifications of the above described electrical connector may similarly be made without departing from the spirit and scope of the present invention.

INDUSTRIAL APPLICABILITY

The present invention is particularly useful in applications that require sealing of electrical connections against adverse environmental conditions such as underwater data acquisition and transmission systems, subsurface or ground level instruments subjected to adverse operational and atmospheric environments such as seismic exploration applications, and other uses where it is desirable to protect the electrical contact portions of the connector.

The present invention, because of the resilient coupling provided between rigid components housing the electrical contact elements, also has important uses in applications where the electrical connector is subjected to high vibration or shock, such as in rough terrain vehicles and earthmoving machines.

Importantly, the electrical connector 10 embodying the present invention comprises individual components that can be disassembled, repaired or replaced, and reassembled, even underwater, without the need of special tools or repair facilities. Thus, the electrical connector described above and defined by the claims is particularly suited for use in remote geographical locations where repair facilities are not readily available.

Other aspects, features and advantages of the present invention can be obtained from a study of this disclosure together with the appended claims.

What is claimed is:

1. An electrical connector, comprising:

a male member having a body formed of a rigid, electrically nonconductive, thermoplastic material and a plurality of electrically conductive pins arranged in a predetermined pattern in said body, said body having a first face surface, a second face surface, and a plurality of sheaths extending outwardly from said first face surface, and each of said electrically conductive pins having a first portion completely encapsulated within the body and a respective one of said sheaths of said male member, a second portion extending outwardly from an outer end of the sheath respectively imbedding the first portion of said pins, and a third portion extending outwardly from the second face surface of the body of said male member, each of said third portions being connectable to an electrical wire conductor;

a female member having a body formed of a rigid, electrically nonconductive, thermoplastic material and a plurality of electrically conductive sockets arranged in said predetermined pattern in the body of said female member and adapted to receive the second portion of a respective one of the pins of said male member and maintain said respective pin in electrically conductive contact with the socket, said body of the female member having a first face surface, a second face surface, and a plurality of sheaths extending outwardly from said first face surface, and each of said electrically conductive sockets having a first portion completely encapsulated within the body and a respective one of the sheaths of said female member and a second portion extending outwardly from the second face surface of the body of said female member, said second portion of each of the sockets being connectable to an electrical wire conductor; and, an elastomeric coupling member formed of a resiliently compressible, nonconductive material and having a first face surface abutable with the first face surface of said male member, a second face surface abutable with the first face surface of said female member, and a plurality of internally disposed passageways extending between said first and second face surfaces of the coupling member, said passageways being arranged in said predetermined pattern and having an internal wall shape adapted to receive and completely surround each of the sheaths of said male and said female members.

2. An electrical connector, as set forth in claim 1, wherein each of the sheaths of said male and female members have a circular cross sectional shape and a predetermined external diameter, and said passageways in the elastomeric coupling member have a circular cross sectional shape defined by an internal wall, said wall having a plurality of annular alternating grooves and ridges formed therein, said ridges forming a plurality of compressibly deformable sealing rings having an internal diameter less than the predetermined external diameter of said sheaths, and said grooves have an internal diameter greater than the predetermined external diameter of said sheaths.

3. An electrical connector, as set forth in claim 1, wherein each of the sheaths of said male member has a first predetermined length and the sheaths of said female members have a second predetermined length, said first predetermined length being greater than said second predetermined length.

4. An electrical connector, as set forth in claim 3, wherein the second portion of said pins extending outwardly from the outer end of said sheaths of the male member has a predetermined length, and the passageways in said coupling member have a predetermined length, the predetermined length of said passageways being greater than the combined predetermined lengths of the second portion of said outwardly extending pins and the sheaths of male member when added together.

5. An electrical connector, as set forth in claim 1, wherein said male and female members are formed of a glass filled polyurethane material.

6. An electrical connector, as set forth in claim 1, wherein said coupling member is formed of thermoplastic rubber material comprising a mixture of polyethylene and neoprene and, after curing, has a room temperature hardness, with reference to the Shore A scale, of from about 40 to about 70 durometer.

7. An electrical connector, as set forth in claim 1, wherein said connector includes a means for maintaining the first face surface of said coupling member in biased contact with the first face surface of said male member and the second face surface of said coupling member in abutting contact with the first face surface of said female member.

8. An electrical connector, as set forth in claim 7, wherein said coupling member has an external circumferential wall surface, and the internal diameter of said internally disposed passageways in the coupling member is reduced in response to imposing an isostatic pressure on the external circumferential wall surface of said coupling member when said coupling member is in abutting contact with said respective first surfaces of the male and female members.

9. An electrical connector, as set forth in claim 7, wherein said means for maintaining the respective face surfaces of the coupling member in biased abutting relationship with the first face surfaces of the male and female members includes a male adaptor member having an internal bore and threads formed in a portion of said bore, a female adaptor member having an internal bore and threads formed in a portion of said bore, and said male and female members each have a plurality of screw threads formed on an external circumferential surface of said members that are adapted to threadably engage the respective internal threads in the internal bore of said male and female adaptor members, and a shell member having means for disconnectably maintaining said male and female adaptor members in fixed spaced relationship with respect to each other.

10. An electrical connector, as set forth in claim 9, wherein said shell member is a tubular member having a peripheral wall defining an internal bore, said peripheral wall having a plurality of slots defining openings through said peripheral wall.

11. An electrical connector, as set forth in claim 10, wherein said means for disconnectably maintaining said male and female adaptor members in fixed spaced relationship includes a plurality of threads formed on an external circumferential surface of the female adaptor member, a radially outwardly extending annular shoulder formed on an external surface of the male adaptor member, a plurality of internal threads formed in said bore of the shell member adjacent a first end of said shell member and adapted to threadably engage the external threads on the female adaptor member, and an annular groove formed in the bore of the shell member adjacent a second end of said shell member and adapted to compressibly receive a snap ring therein, 12. An electrical connector, comprising:

a male member formed of a rigid thermoplastic material and having a face surface and a plurality of sheaths extending outwardly from said face surface, and a plurality of electrically conductive pins each having a portion encapsulated by a respective one of said sheaths;

a female member formed of a rigid thermoplastic material and having a face surface and a plurality of sheaths extending outwardly from said face surface, and a plurality of electrically conductive sockets each of which are encapsulated by a respective one of said sheaths;

a coupling member formed of a resiliently compressible elastomeric material and having a pair of spaced apart end faces, an external wall surface extending between said end faces, and a plurality of internal passageways adapted to sealably receive the sheaths of said male and female members therein, said coupling member being interposed said male and female members with each one of the end faces of said coupling member in abutting contact with a respective end face surface of the male and female member, said internal passageways of the coupling member being radially reduced in response to applying an essentially isostatic pressure on said external wall surface of the coupling member and thereby increasing the sealing of said passageways about said sheaths.

13. An electrical connector, as set forth in claim 12, wherein each of the sheaths of said male and female members have a circular cross sectional shape and a predetermined external diameter, and said passageways in the elastomeric coupling member have a circular cross sectional shape defined by an internal wall, said wall having a plurality of annular alternating grooves and ridges formed therein, said ridges forming a plurality of compressibly deformable sealing rings having an internal diameter less than the predetermined external diameter of said sheaths, and said grooves have an internal diameter greater than the predetermined external diameter of said sheaths.

14. An electrical connector, as set forth in claim 12, wherein said male and female members are formed of a glass filled polyurethane material.

15. An electrical connector, as set forth in claim 12, wherein said coupling member is formed of thermoplastic rubber material comprising a mixture of polyethylene and neoprene and, after curing, has a room temperature hardness, measured against the Shore A scale, of from about 40 to about 70 durometer.

* * * * *